United States Patent [19]

Geleziunas

[11] Patent Number: 4,844,310

[45] Date of Patent: Jul. 4, 1989

[54] DISPENSER FOR A ROLL OF SHEET MATERIAL

[76] Inventor: Rimas J. Geleziunas, 3900 Yonge Street, Toronto, Ontario, Canada, M4N 3N6

[21] Appl. No.: 49,476

[22] Filed: May 14, 1987

[51] Int. Cl.[4] ..... B65H 16/02; A47K 10/22

[52] U.S. Cl. ..... 225/43; 225/38; 225/46; 225/54

[58] Field of Search ..... 225/38, 42, 43, 46, 225/47, 53, 54, 77, 80, 88, 90

[56] References Cited

U.S. PATENT DOCUMENTS

| | | | |
|---|---|---|---|
| 690,165 | 12/1901 | Leonhard | 225/46 |
| 2,117,375 | 5/1938 | Steiner | 225/43 X |
| 3,425,606 | 2/1969 | Burke | 225/77 |
| 3,603,519 | 9/1971 | Brown | 225/38 X |

FOREIGN PATENT DOCUMENTS

| | | | |
|---|---|---|---|
| 110243 | 4/1899 | Fed. Rep. of Germany | 225/43 |

*Primary Examiner*—Frank T. Yost
*Assistant Examiner*—Michael D. Folkerts
*Attorney, Agent, or Firm*—Rogers, Bereskin & Parr

[57] ABSTRACT

A dispenser for a roll of sheet material has a body that defines an elongate chamber open at the front. Baffle and closure members are pivotally mounted to the body for movement between open and closed positions. The baffle member can be mounted at a lower edge, whilst the closure member is mounted at an upper edge. A closure member includes a cutting edge for a sheet of material. In the closed positions of the baffle and closure members, material from a roll passes through a gap formed between the baffle and closure members. A piece of the sheet of material can then be torn off by one hand, by pulling it against the cutting edge.

19 Claims, 2 Drawing Sheets

FIG. 1
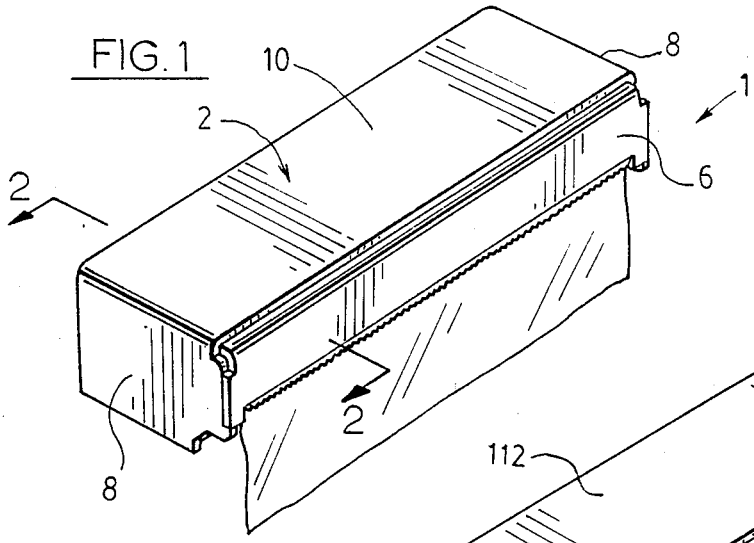
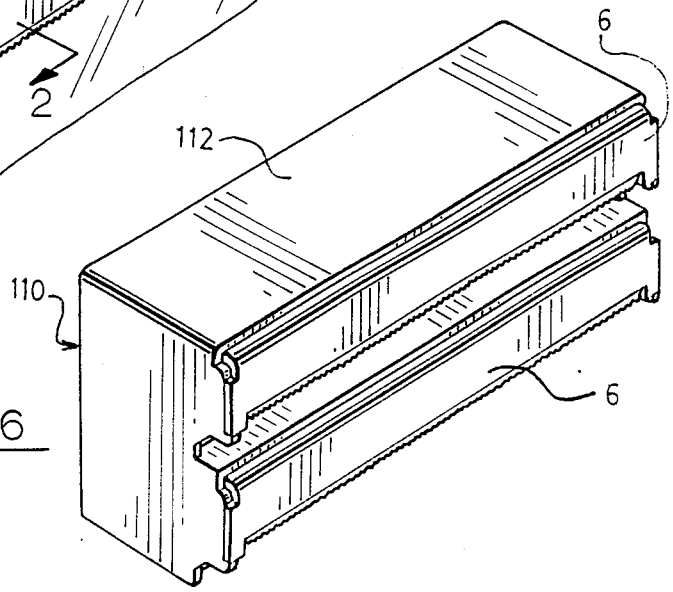
FIG. 6
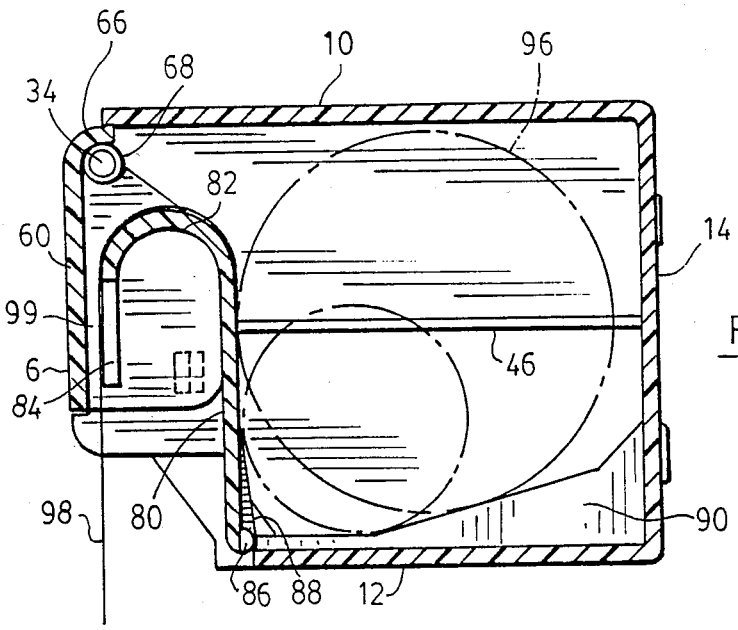
FIG. 2

FIG. 3
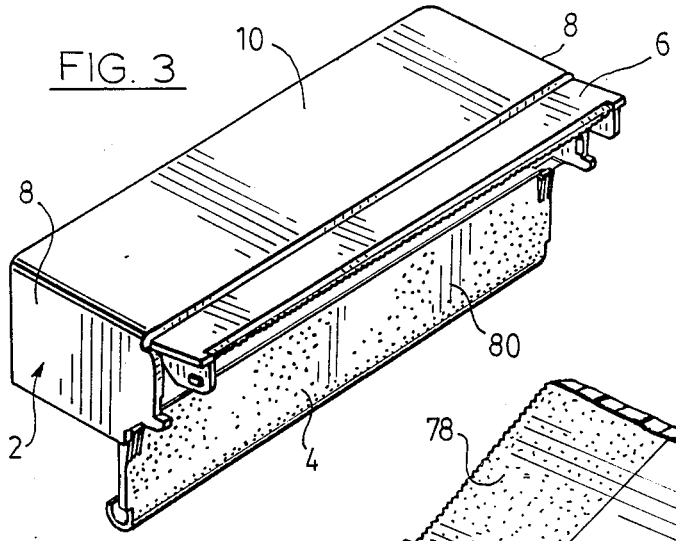
FIG. 5
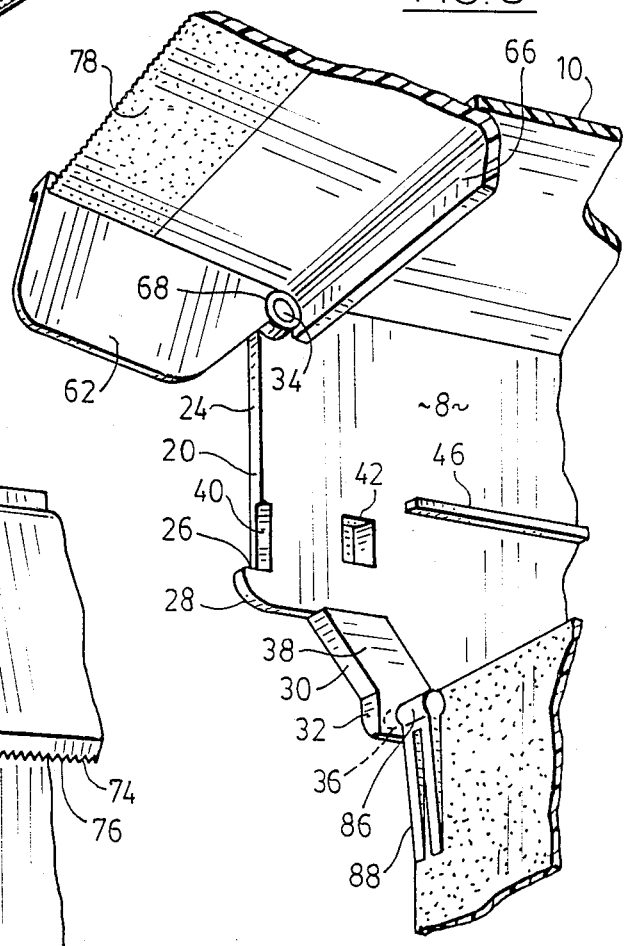
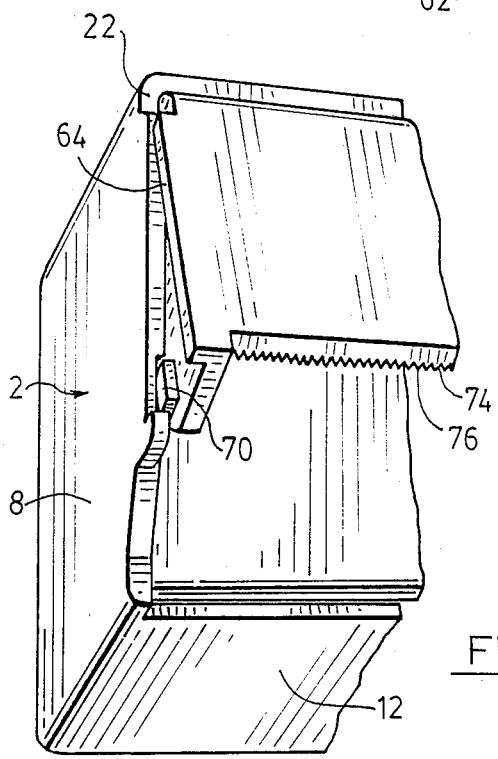
FIG. 4

DISPENSER FOR A ROLL OF SHEET MATERIAL

FIELD OF THE INVENTION

This invention relates to a dispenser for a roll of sheet material, and it more particularly relates to a dispenser for a roll of plastic wrap material which is adapted to cling to a variety of surfaces.

BACKGROUND OF THE INVENTION

At the present time, a variety of sheet materials are used in kitchens, and for other household uses, such as aluminum foil, waxed paper and plastic wrap. Plastic wrap is a thin sheet of transparent plastic material, which has the property of clinging to a variety of solid surfaces. It is usually provided on a roll. As required, portions of the wrap are torn from the roll, and used to protect food or other items. Thus, a piece of the wrap can be placed across the top of a bowl prior to storage in a refrigerator, to retain moisture in food in the bowl. The wrap will cling to a variety of surfaces, including metal, ceramic and plastic.

Commonly, the material is supplied in a roll, in a cardboard box. One edge of the box is provided with a simple, toothed cutting edge. To cut the material, a free end of it is pulled from the box, and it is then pressed against the cutting edge to cut it. However, this requires two hands, one to hold the box and one to hold the free edge of the wrap. Further, the disposable cutting edge provided on the box is frequently inadequate, and does not tear the wrap easily or efficiently.

Since the plastic wrap is specifically made to cling to solid surfaces, it is difficult to handle. Proposals have been made for dispensers for such wrap. However, dispensers suffer from a variety of disadvantages. Frequently, the wrap will not run freely through them. Some dispensers require a two handed operation.

What is required is a dispenser for a roll of sheet material, particularly a roll of plastic wrap, which dispenses the material smoothly, and which can be reliably operated with one hand. Thus, the dispenser should enable a piece of the wrap to be easily and simply torn off with one hand.

BRIEF SUMMARY OF THE INVENTION

In accordance with the present invention, there is provided a dispenser for a roll of sheet material, the dispenser comprising a body defining an elongate chamber open at the front thereof, a baffle member pivotally mounted to the body for movement between an open position and a closed position abutting the abutment and retaining a roll of material within the chamber, a closure member having a cutting edge for cutting the sheet material and side tabs extending rearwardly and pivotally mounted to the body at the front thereof for movement between an open position and a closed position in which the side tabs hold the baffle member in its closed position against the abutment, wherein with, the baffle and closure members in their closed positions a substantial portion of the closure member lies in front of the baffle member so as to define a slot for the sheet material, and releasable retaining and securing means for retaining the closure member in the closed position.

The dispenser can be used for a variety of sheet materials, for example aluminum foil, plastic wrap or wax paper. The dispenser can further be provided with two chambers for two separate rolls, with each chamber having a respective baffle member and closure member.

In use, the free end of the roll of sheet material is fed through the slot between the baffle and closure members. When it is desired to tear off a piece of the sheet, the free end is simply grasped and pulled in a direction pressing it against the cutting edge. The friction generated between the roll of material, and the baffle and closure members and the body serves to hold the roll in position as the sheet is cut on the cutting edge. Consequently, if the body is mounted, for example to a wall, then a part of the sheet can readily be torn off by one hand.

For plastic wrap, surfaces of the baffle and closure members which contact the wrap are given a frosted or roughened finish, which is sufficient to prevent the wrap from sticking to them. Further, to support the roll within the body, ribs can be provided to minimize the contact area between the roll and the body, again to prevent clinging of the roll of plastic wrap to the body.

The individual proponents of the dispenser can be moulded from a hard ABS plastic. The cutting edge can be a toothed cutting edge integrally moulded with the closure member.

BRIEF DESCRIPTION OF THE DRAWINGS

For a better understanding of the present invention, and to show more clearly how it may be carried into effect, reference will now be made, by way of example, to the accompanying drawings, in which:

FIG. 1 is a perspective view of a first embodiment of a dispenser according to the present invention in a closed configuration;

FIG. 2 shows a section along the line 2—2 of FIG. 1;

FIG. 3 shows a perspective view of the dispenser of FIG. 1 in an open configuration;

FIG. 4 shows a perspective view from below of one end of the dispenser of FIGS. 1–3, on a larger scale;

FIG. 5 shows a perspective view of the one end shown in FIG. 4, in an open configuration; and FIG. 6 is a perspective view of a second embodiment of the dispenser.

DESCRIPTION OF THE PREFERRED EMBODIMENTS

The first embodiment of the dispenser is generally denoted by the reference 1. This dispenser 1 is intended for a single roll of material. The dispenser 1 includes a body 2, a baffle member 4 and a closure member 6.

The body 2 has generally rectangular side. Thus, the body 2 includes end walls 8 facing one another, and top and bottom walls 10, 12. A rear wall 14 extends between these various walls 8, 10, and 12, and the body 2 is open at the front opposite the rear wall 14. The body 2 is generally symmetrical about a vertical plane through the middle of it parallel to the end walls 8, and it defines an elongate chamber for a roll of material.

Each end wall 8 is shaped at the front to accommodate the baffle member 4 and closure member 6 (FIGS. 4 and 5). The front edge of each end wall 8 is designated by the reference 20, and includes an uppermost edge portion 22. An intermediate edge portion 24 is stepped out from the uppermost edge portion 22 and extends vertically. A step 26 and a rounded portion 28 are below the intermediate edge portion 24. An inclined portion 30 extends from the rounded portion 28 and is continuous with a lowermost portion 32.

At the top of the uppermost edge portion 22, there is a pivot projection 34, which as shown is rounded, and can be hollow. A pivot socket 36 is formed adjacent to the lowermost portion 32. The socket 36 is formed adjacent to the lowermost portion 32. The socket 36 is formed in a thickened part 38. A bevelled edge 40 is provided at the bottom of the intermediate portion 24 as shown. The recess 42 is provided, corresponding to the bevelled edge 40. The recess 42 has a profile corresponding to a locking projection of the closure member 6, as detailed below.

Also, each end wall 8 includes a rib 46, for preventing excess contact with a roll of material.

The closure member 6 has an elongate, plane panel 60, which forms a front wall of the body 2 in use. The closure member 6 is generally symmetrical about a vertical plane, and is thus identical at either end. At each end, a side tab 62 extends backwards from the plane panel 60. An extension flange 64 extends from the side of the panel 60, and its length equals the thickness of each end wall 8. Extending from the top of the panel 60 is a rounded flange 66. As shown, the flange 66 together with the side tab 62 forms a pivot recess 68, which extends through slightly more than 180 degrees, for engaging a pivot projection 34.

At the bottom of each side tab 62, on the outside thereof, there is a locking projection 70. As shown, three of the side walls of the projection 70 are generally perpendicular to the face of the tab 62, with the exception of the rearmost side face. This rearmost side face is bevelled.

The lower edge of the plane panel 60 is bevelled, and provided with teeth 74, this serves to form a cutting edge 76.

As shown, the lowermost part of the inner surface of the plane panel 60 is provided with a roughened or frosted finish, as marked at 78.

The baffle member 4 has dimensions corresponding to those of the closure member 6. The baffle member 4 includes a main planar panel 80. Extending from the top of the planar panel 80 is a semi-circular sectional part 82 providing a bearing surface. Two extension tabs 84 extend downwards from the free edge of the semi-circular part 82.

The rear face of the main panel 80, the top of the semi-circular part 82 and the front face of the tabs 84 are provided with a frosted or roughened finish.

At the lower corners of the main panel 80, short pivot pins 86 are formed. As shown, these pivot pins 86 are reinforced by ribs 88.

As shown in FIG. 2, the ribs 46 are dimensioned so that the baffle member 4 in its closed position abuts the ribs 46. The side tabs 62 are also dimensioned to abut the baffle member 4 to hold it in position.

Within the body 2, there are two ribs 90. As shown, the upper surfaces of the ribs 90 are inclined, so that the ribs 90 taper towards the front of the body 2. The top edge of the ribs 90 include 2 inclined portions at the rear thereof, and are horizontal at the front thereof.

In the assembled condition, the pivot pins 86 of the baffle member 4 are engaged in the pivot sockets 36. Correspondingly, the pivot projections 34 of the end walls 8 are engaged in the pivot recesses 68. To load a roll of material in the dispenser 1, the baffle and closure members 4, 6 are rotated to and open position (FIG. 3). The closure member 6 can be opened simply by pulling the middle of its panel 60. This has the effect of bending the closure member 6, causing the locking projections 70 to pull out of the recesses 42. A roll of material, denoted by the reference 96 is then loaded in the body 2. The roll 96 can be mounted with the material extending from the top or bottom thereof; the roll 96 is shown with the material extending from the bottom of the roll. Then, with reference to FIG. 2, the baffle member 4 is rotated clockwise, and the free edge of the material 98 is arranged extending over the baffle member 4. The closure member 6 is then rotated counter-clockwise, until its locking projections 70 re-engage the recesses 42. The closure member 6 then holds the baffle member 4 and roll 96 in position.

Then, as shown, the free end 98 of the material extends through a slot 99 between the baffle and closure members 4, 6 and from underneath the closure member 6. To tear off a piece of the material, the free end 98 is grasped and pulled downwards. The roll then unwinds. The roll sits on the ribs 90, and the ribs 46 prevent contact with the end walls 8, so that the roll 96 should rotate freely irrespective of the material. Further, the free end 98 extends over the frosted surface of the baffle member 4, and contacts the frosted rear surface of the closure member 6, so that there is little or no tendency for the material to stick to either of these components. When the desired length of material has been pulled out, the free end 98 is lifted upwards, so that the material contacts the cutting edge 76. The free end 98 is pulled with a sideways motion, so that a cut progresses along the cutting edge 76. The new free end 98 of the material will terminate at the cutting edge 76. The space between the baffle and closure members 4, 6 is wide enough for a user's fingers. Consequently, the user can reach behind the closure member 6 to pull the new free end 98 down from behind the closure member 6. Pieces of the material 96 can then be torn off as desired.

The extension tabs 84 of the baffle member 4 maintain the free end 98 against the rear of the closure member 6 so that it can be grasped. Without the tabs, the material may have a tendency to cling or lie against the front face of the baffle member 4.

The individual components, namely the body 2, baffle member 4, and closure member 6, can be individually moulded in a suitable plastic material. For example, they could be moulded in a hard ABS plastic. The frosted surfaces of the baffle and closure members 4, 6 must then be provided with a suitable finish, i.e. a non-glossy finish. For example, a number 6 SPIC (Society of Plastics Institute) finish has been found to be suitable.

It is expected that the dispenser 1 will be mounted to a vertical surface by its rear wall 14. For this purpose, the rear wall 14 includes embossed areas 16.

FIG. 6 shows a variant embodiment of the dispenser, denoted by the reference 110. The dispenser 110 has a body 112, formed in one piece. The body 112 defines two chambers for rolls of material, one above the other, with each corresponding to the single elongate chamber of the first embodiment. Each chamber is provided with respective baffle and closure members 4, 6 as for the first embodiment. Thus, each chamber and its associated components are the same as in the first embodiment, and the description is not repeated. This enables simultaneous storing of two rolls of different material.

I claim:

1. A dispenser for a roll of sheet material, the dispenser comprising a body defining an elongate chamber open at the front thereof and including an abutment, a baffle member pivotally mounted to the body for movement between an open position and a closed position abutting the abutment of the body and retaining a roll of material within the chamber, a closure member having a cutting edge for cutting the sheet material and side tabs extending rearwardly and being pivotally mounted to the body at the front thereof for movement between an open position and a closed position in which the side tabs abut the baffle member on the side opposite the abutment to hold the baffle member in its closed position against the abutment, wherein with the baffle and closure members in their closed positions, a substantial portion of the closure member lies in front of the baffle member so as to define a slot for the sheet material, and releasable retaining means for securing and retaining the closure member in the closed position.

2. A dispenser as claimed in claim 1, in which the baffle member is pivotally mounted along one edge thereof and includes a main portion extending from that one edge and extension tabs in front of the main portion extending towards that one edge, which tabs, with the baffle and closure members in their closed positions, are spaced from the closure member and space sheet material from the main portion of the baffle member.

3. A dispenser as claimed in claim 2, in which the body includes bottom and top walls, the baffle member is pivotally mounted along said one edge adjacent to the bottom wall, and the closure member is pivotally mounted along one edge thereof adjacent to the top wall.

4. A dispenser as claimed in claim 3 wherein the body includes end walls and pivot projections extending out from the end walls, and the closure member includes pivot recesses engaging the pivot projections.

5. A dispenser as claimed in claim 4, wherein each pivot recess is open on one side and extends through an angle greater than 180 degrees.

6. A dispenser as claimed in claim 3, wherein the closure member comprises a generally rectangular plane panel having a lowermost edge opposite said one edge of the closure member, said side tabs which extend rearwardly from the plane panel, and a row of teeth extending along the lowermost edge thereof to form a cutting edge.

7. A dispenser as claimed in claim 3, 5 or 6, in which the body includes end walls and ribs extending from the end walls towards one another; with ends of the ribs forming said abutment.

8. A dispenser as claimed in claim 3, wherein the baffle member comprises a main, planar panel, having a lowermost edge providing said one edge of the baffle member, a semi-circular part extending from an uppermost edge of the main, planar panel, and said extension tabs extending downwardly from the semi-circular part.

9. A dispenser as claimed in claim 8, wherein the baffle member includes pivot pins extending outwardly from the planar panel, and the body includes pivot sockets receiving the pivot pins.

10. A dispenser as claimed in claim 8, wherein the closure member comprises a generally rectangular plane panel having a lowermost edge opposite said one edge of the closure member, said side tabs which extend rearwardly from the plane panel, and a row of teeth extending the lowermost edge thereof to form a cutting edge.

11. A dispenser as claimed in claim 10, wherein the body includes end walls and pivot projections extending out from the end walls and the closure member includes pivot recesses engaging the pivot projections and wherein the baffle member includes pivot pins extending outwardly from the planar panel thereof, and the body includes pivot sockets receiving the pivot pins.

12. A dispenser as claimed in claim 8, 10 or 11, wherein, for the baffle member, a rear face of the main planar panel, an outside surface of the semi-circular part and a front face of the extension tabs are provided with a frosted finish, and for the closure member, a rear face thereof is provided with a frosted finish.

13. A dispenser as claimed in claim 10, wherein the body includes ribs extending upwardly from the bottom wall and extending from the front to the rear of the dispenser, for spacing a roll of sheet material from the bottom wall.

14. A dispenser as claimed in claim 13, wherein the ribs extending upwardly from the bottom wall include upper edges which are inclined downwardly towards the front of the dispenser.

15. A dispenser as claimed in claim 3, 6 or 8, wherein the retaining means comprises locking projections extending outwardly from the side tabs of the closure member, and corresponding locking recesses in the end walls of the body.

16. A dispenser as claimed in claim 3, wherein the retaining means comprises locking projections extending outwardly from the side tabs of the closure member, and corresponding locking recesses in the end walls of the body, and wherein the locking projections include a bevelled edge, and edges of the end walls of the body are provided with corresponding bevelled edges, to facilitate entry of the closure member into the body.

17. A dispenser as claimed in claim 16, wherein the end walls include front edges, each of which includes a generally vertical intermediate edge portion, with the bevelled edge provided at the bottom of the intermediate edge portion, and an inclined portion extending downwardly and rearwardly from the intermediate portion.

18. A dispenser as claimed in claim 17, wherein each front edge includes a rounded portion between the intermediate edge and inclined portions.

19. A dispenser as claimed in claim 1, 3 or 16, wherein the body defines a second elongate chamber, which is open at the front thereof and includes a second abutment, and which is provided with a second baffle member pivotally mounted to the body for movement between an open position and a closed position abutting the second abutment and retaining a second roll of sheet material within the chamber, a second closure member having a cutting edge for cutting the sheet of material and respective side tabs extending rearwardly and being pivotally mounted to the body for movement between an open position and a closed position in which the side tabs thereof hold the second baffle member in its closed position against the second abutment, wherein with the second baffle and closure members in their closed position, a substantial portion of the second closure member lies in front of the second baffle member so as to define a second slot for a second sheet material, and a second releasable retaining means for securing and retaining the second closure member in its closed position.

* * * * *